US005339659A

United States Patent [19]

Guzzinati

[11] Patent Number: 5,339,659

[45] Date of Patent: Aug. 23, 1994

[54] SECURITY LOCK WITH TWO LOCKING MECHANISMS, OF THE PUMP TYPE AND OF THE DOUBLE-BIT TYPE, RESPECTIVELY

[75] Inventor: Alberto Guzzinati, Sant'Ambrogio, Italy

[73] Assignee: Mottura Serrature Di Sicurezza SpA, Turin, Italy

[21] Appl. No.: 964,722

[22] Filed: Oct. 22, 1992

[30] Foreign Application Priority Data

Oct. 25, 1991 [IT] Italy ..... T091U000266

[51] Int. Cl.[5] ..... E05B 63/14

[52] U.S. Cl. ..... 70/120; 70/409; 70/150; 70/338; 70/DIG. 63; 70/395; 292/150

[58] Field of Search ..... 70/120, DIG. 63, 150, 70/401, 352, 408, 409, 475, 476, 477, 478, 479, 337, 338, 342, 343, 395; 292/150

[56] References Cited

U.S. PATENT DOCUMENTS

| | | | |
|---|---|---|---|
| 238,113 | 2/1881 | Hand | 70/150 |
| 890,172 | 6/1908 | Papenfoth | 70/342 |
| 970,252 | 9/1910 | Mason | 70/342 |
| 1,150,617 | 8/1915 | Page | 70/343 |
| 1,383,631 | 7/1921 | Hoffman | 292/150 |
| 1,953,292 | 4/1934 | Dube | 70/150 |
| 2,449,711 | 9/1948 | Milligan | 70/478 |
| 3,841,120 | 10/1974 | Gartner | 70/408 |
| 4,305,267 | 12/1981 | Nish et al. | 70/395 |
| 4,641,507 | 2/1987 | Demonbreun | 70/DIG. 63 |

FOREIGN PATENT DOCUMENTS

| | | | |
|---|---|---|---|
| 1475532 | 7/1914 | France | 70/408 |
| 581599 | 5/1924 | France | 70/DIG. 37 |
| 1501921 | 9/1966 | France | 70/338 |
| 2588601 | 4/1987 | France | 70/478 |
| 614149 | 12/1960 | Italy | 70/120 |
| 1483603 | 8/1977 | United Kingdom | 70/395 |

*Primary Examiner*—Peter M. Cuomo
*Assistant Examiner*—Darnell M. Boucher
*Attorney, Agent, or Firm*—Edward D. Manzo

[57] ABSTRACT

A security lock for doors of dwellings, gates and the like comprises a pump-type locking mechanism for operating a bolt, and a double-bit locking mechanism for locking the pump mechanism in its locking condition. The lock preferably has both a key which can operate only the pump mechanism and a key which can operate both mechanisms. A cover made of plastics material is associated with the key and can be fitted onto the operative portion of the key in order to protect its teeth against dirt and against the risk of breakage as a result of the key being dropped.

10 Claims, 4 Drawing Sheets

SECURITY LOCK WITH TWO LOCKING MECHANISMS, OF THE PUMP TYPE AND OF THE DOUBLE-BIT TYPE, RESPECTIVELY

DESCRIPTION

The present invention relates to security; locks for doors of dwellings, gates and the like, of the type including a case, a bolt which is movable in the case between an unlocking position and a locking position, and a pump-type locking mechanism for operating the bolt.

In order to increase the level of security provided by the lock, the subject of the invention is a lock of the aforementioned type, characterised in that it also includes a second locking mechanism of the double-bit type, which is disposed inside the case and is used to lock the first pump mechanism in the locked condition.

The structure according to the invention offers many advantages. If a duplicate of the key for the pump mechanism is entrusted to an outsider (for example, to a domestic helper or to a supplier), to enable the outsider to enter the house when the owner is absent, if he so wishes the owner can set the lock in its locked condition by also locking the double-bit mechanism, the owner being the only person who has the key for this purpose. The owner's key will preferably be able to operate both mechanisms, in order to avoid the inconvenience resulting from the use of two separate keys.

According to a further characteristic constituting a subject of the invention, in order to protect its toothed portion for operating the mechanisms, the key has a cover comprising a tray-shaped element of plastics material which can be fitted around its operative portion and has two shorter edges each with a central recess for engaging the shaft of the key.

Further characteristics and advantages of the invention will become clear from the following description, with reference to the appended drawings, provided purely by way of non-limiting example, in which.

Figure 1:
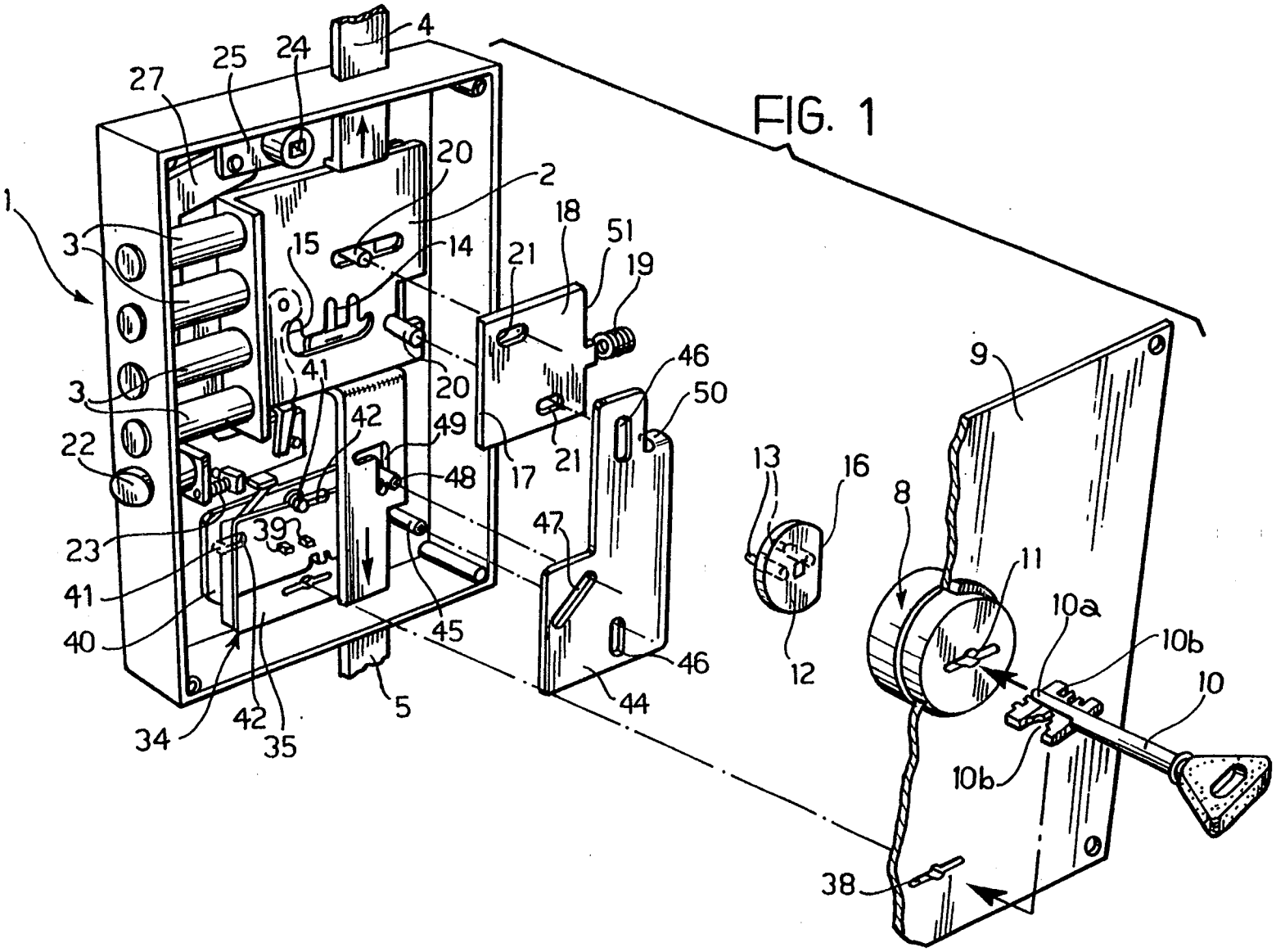
FIG. 1 is a schematic, perspective view of the lock according to the invention.

In the drawings, a metal case, generally indicated 1, has an open side, and is intended to be fixed to a door of a dwelling, a bolt plate 2 which, in known manner, carries four cylindrical bolts 3 being slidable therein. The bolt plate 2 is slidable between a first position (FIGS. 1, 2), in which the cylindrical bolts 3 are retracted within the case, and a second position (FIG. 3), in which the cylindrical bolts 3 project from one edge of the case and engage corresponding seats in a keeper element (not shown), of known type, fixed to the door frame.

An upper plate 4 and a lower plate 5, also slidable in the case 1 vertically, are intended to be connected to two vertical bolts for cooperating with corresponding seats in the floor at the bottom and in the door frame at the top. The two plates 4, 5 are moved simultaneously between retracted positions and projecting positions as a result of the movement of the bolt plate 2. This is achieved in known manner by the engagement of pins 6 carried by the plate 2 in oblique slots 7 in the plates 4, 5.

The bolt plate 2 is moved, in known manner, by a pump-type locking mechanism 8, attached to a cover 9 which closes the case 1. The mechanism 8 is not shown in detail since it is of known type, and does not fall within the scope of the present invention. According to the prior art, this mechanism is operated by a key 10, which is inserted in its seat 11, pushed axially, and then rotated. During the pushing stage, the toothed front edge **10*a*** of the operative portion of the key operates the safety mechanism so that the key can subsequently be rotated.

The rotation of the key imparts a corresponding rotation to a plate 12 bearing a pair of pins 13 which subsequently engage a toothed edge 14 of an aperture 15 in the plate 2 so as to move the plate 2 between its two stop positions.

The plate 12 is shaped like a disc with a flat edge 16 which, when the key 10 is in its starting position, is in contact with an end edge 17 of a further plate 18. The plate 18 is slidable in the case 1, in the same direction as the bolt plate 2, and is subject to the action of a spring 19 which constantly urges the plate against the disc 12. The sliding of the plate 18 is guided by pins 20 which are fixed to the back of the box 1 and engaged in corresponding slots 21 in the plate 18.

When the pump mechanism 8 is operated by the key 10, the rotation of the disc 12 thus retracts the plate 18 against the action of the spring 19, and the plate 18 returns to its original position when the flat edge 16 of the disc 12 comes into contact with the end edge 17 of the plate 18 once more.

In known manner, the lock includes a spring latch or "half-turn" unit 22 for cooperating with a corresponding seat (not shown) in the door frame, in order to hold the door in its closed position. The spring latch 22 is slidable in the case 1, and is subject to the action of a spring 23, which keeps it in its projecting, operative position. According to the prior art, the spring latch can be retracted against the action of the spring 23, either by the operation, from the inner side of the door, of a handle (not shown), the square pin of which fits in a square hole 24 in a lever 25, or by means of the key 10 which operates the mechanism 8. In the first case the lever 25 is pivoted clockwise (with reference to FIG. 2) against the action of a spring 26. This pivoting is transmitted to a lever 27 which pivots on a pin 28 and has an end 29 for acting on the plate of the spring latch 22 to retract it. In the second case, when the disc 12 is rotated, one of its pins 13 engages a lever 30 which pivots on a pin 31 and has an end 32 for acting against a pin 33 which is an integral part of the plate of the spring latch 22.

The lock according to the invention includes a second, double-bit locking mechanism, generally indicated 34, which can be used to retain the pump mechanism 8 in its locked condition. The structure of the double-bit mechanism 34 is not described in detail in the present description, since it is of known type and does not fall within the scope of the invention. As is known, the mechanism includes a plurality of plates 35 with corresponding toothed windows 36. The plates 35 are biased vertically by flexion springs 37. When the key 10 is inserted through a keyhole 38 in the cover 9, the lateral toothed edges **10*b* of its operative portion engage the toothed edges of the windows 36 so as to cause a precise displacement of each plate 35 against the action of the respective spring 37. The displacements thus effected are such as to arrange the windows 36 so that they leave a passageway free for the horizontal sliding of one or more pins 39 carried by a plate 40 which is mounted in the case by the engagement of pins 41 in slots 42 in the plate 40 so that it can slide along a line parallel to the line of sliding of the bolt 2. The plate 40 also includes a toothed edge 43 which is engaged by the operative portion of the key 10 so that the turning of the key causes the plate 40** to slide.

A further plate element 44 is also slidable vertically in the box. The sliding of the plate element 44 is guided by the engagement of one of the pins 20 described above, and a pin 45, which is also fixed to the back of the case, in corresponding slots 46 in the plate element 44. The plate element 44 also has an oblique slot 47 which is engaged by a pin 48 carried by the plate 40. The pin 48 is also engaged in an L-shaped slot 49 in the plate 5.

As a result of the engagement of the pin 48 in the L-shaped slot 49, the plate 40 can move horizontally only when the plate 5 is in its lower, projecting position, that is, when the bolt 2 is in its locking position. In this condition, the pin 48 is, in fact, in the horizontal branch of the L-shaped slot 49, and the plate 40 can therefore slide. In this condition the locking of the double-bit mechanism 34 moves the plate 40 towards the left (with reference to FIG. 1). As already stated, this movement is not prevented by the slot 49, since the bolt 2 is in its locking position and the pin 48 is in the horizontal portion of the slot 49. At the same time, as a result of the engagement of the pin 48 in the oblique slot 47 the movement of the plate 40 towards the left causes the plate element 44 to rise to a position in which a bent tab 50 on the plate element 44 is level with the rear edge 51 of the plate 18, so as to prevent this plate, from being retracted against the action of the spring 19. Thus, in this condition, the bolt plate 2 can no longer be released, since the disc 12 of the pump mechanism 8 is prevented from rotating by the engagement of the plate 18 (which cannot be retracted) against the flat edge 16 of the disc 12. The pump mechanism is therefore retained in its locked condition. In order to release the lock, the double-bit mechanism 34 must, first of all, be released so as to return the plate element 44 to its lowered position, after which the pump mechanism 8 can be operated.

Figure 3:
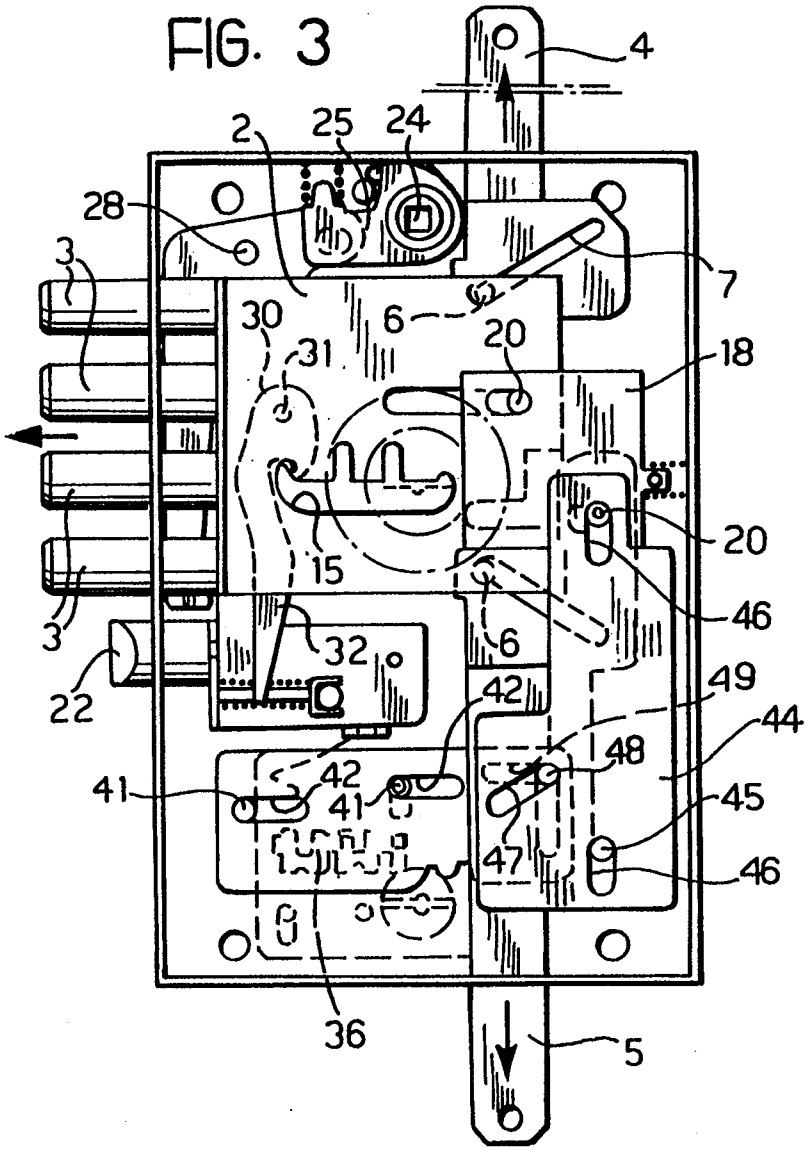
FIGS. 2–4 are front views of the lock, shown in three different operative conditions with its cover removed.
Figure 2:
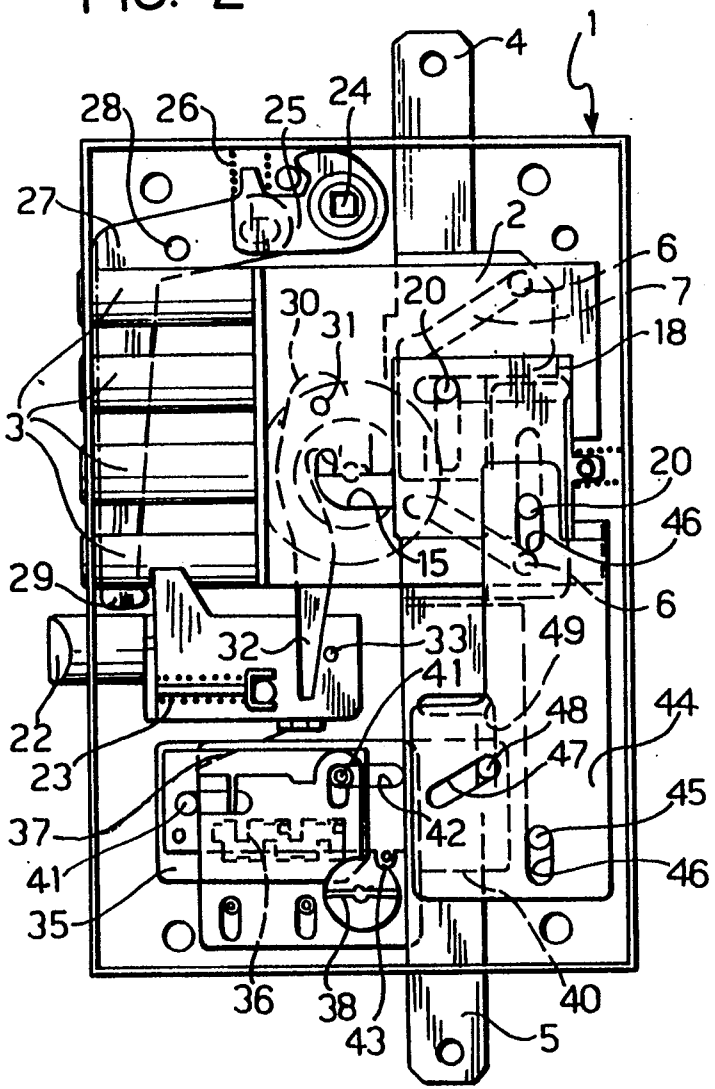
Figure 4:
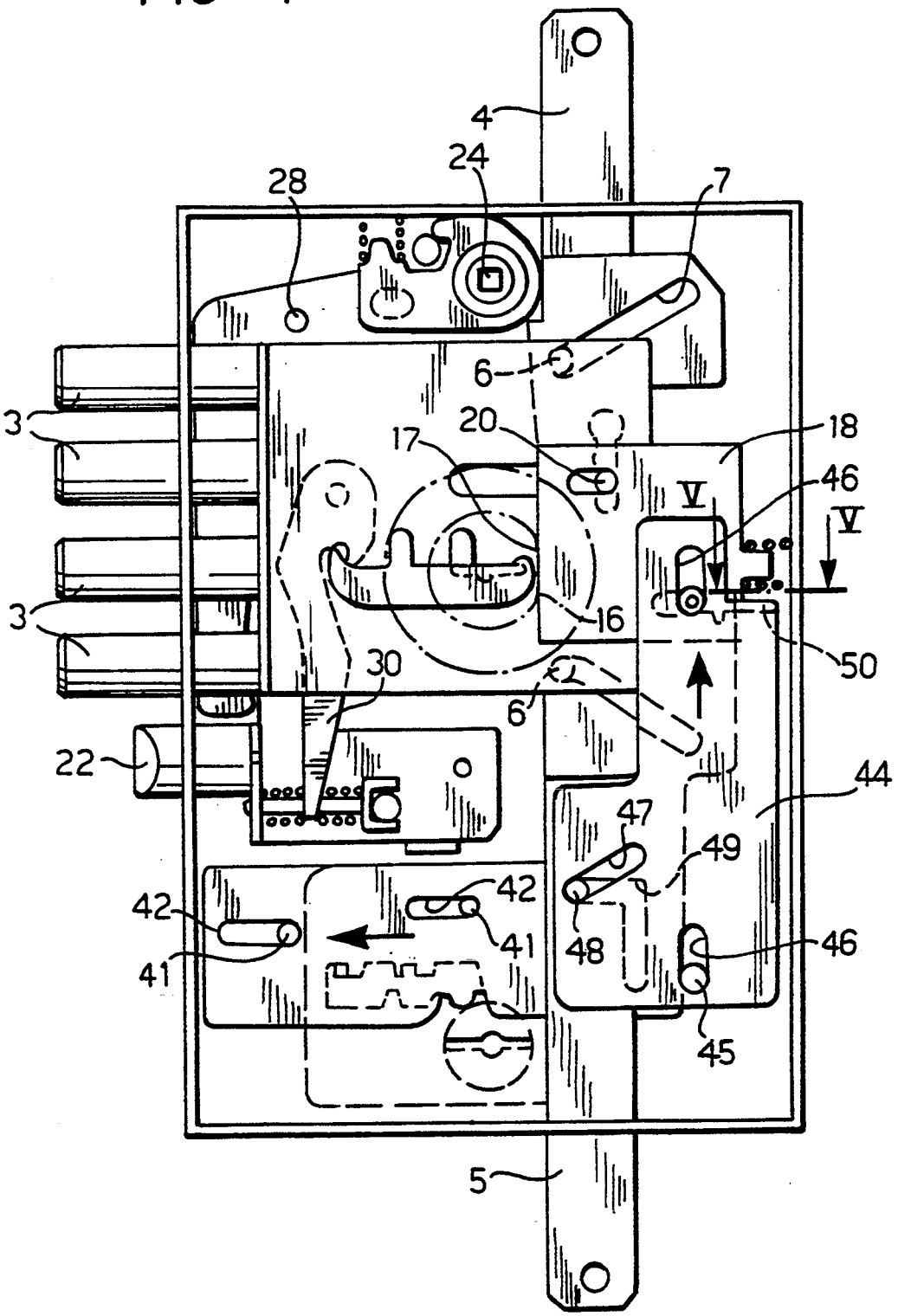

FIGS. 2, 3 and 4 show the lock in the fully unlocked condition, in a condition in which the bolt is in its locking position but the double-bit mechanism is still unlocked, and in a condition in which the bolt is retained in its locking position by means of the double-bit mechanism respectively.

Figure 5:
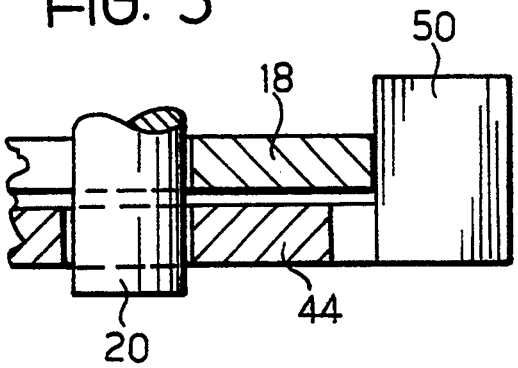
FIG. 5 is a cross-section taken on the line V—V of FIG. 4, on an enlarged scale.
Figure 7:
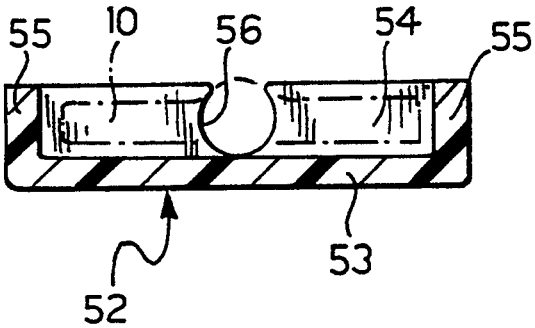
FIG. 7 is a cross-section taken on the line VII—VII of FIG. 6.

FIG. 5 shows in detail the engagement of the tab 50 against the plate 18.

Figure 6:
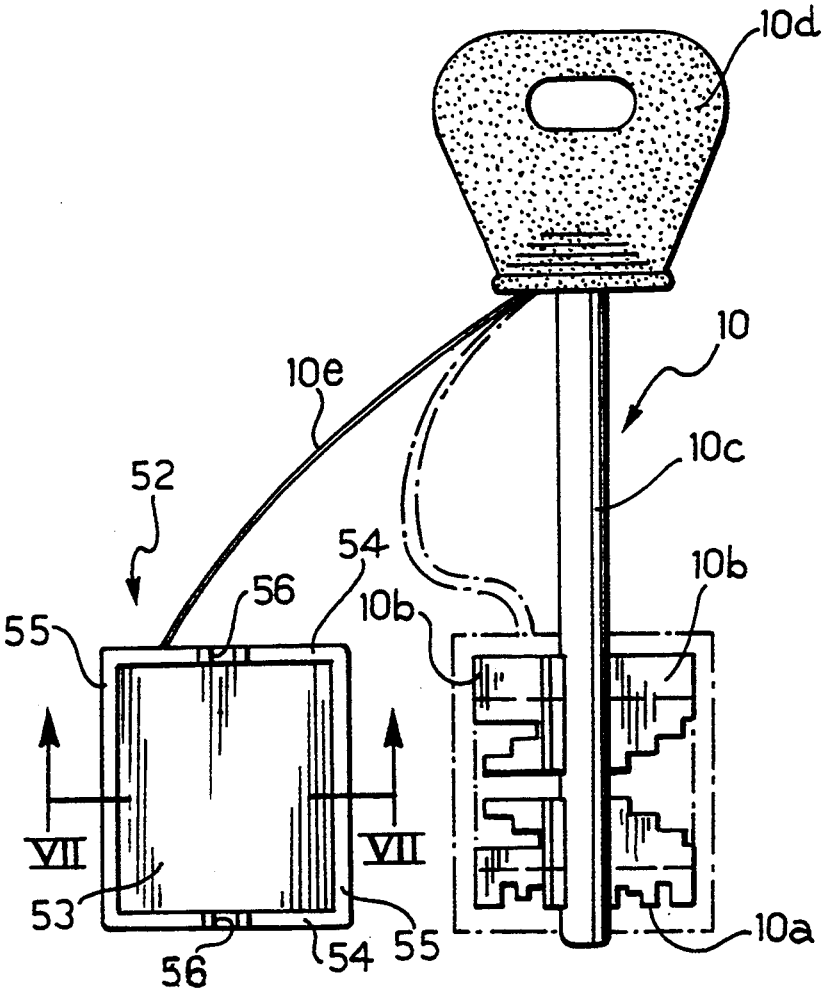
FIG. 6 shows a key which can be used to operate both mechanisms of the lock according to the invention.

FIG. 6 shows a key 10 having an operative portion with a toothed front edge **10*a* for operating the pump mechanism 8 and toothed side edges 10*b* for operating the double-bit mechanism 34. In order to protect the operative portion of the key against dirt and against the risk of damage to the teeth if the key is dropped, it has a tray-shaped cover 52 of plastics material with a base 53, two shorter raised lips 54 and two longer raised lips 55. Each shorter lip 54 has a central recess 56 for the engagement of the shaft 10*c* of the key (see the position indicated by the dotted line in FIG. 6). The element 52 is preferably fixed to the grip 10*d* of the key by means of a flexible member 10*e***.

As already indicated, the lock has one or more keys suitable only for operating the pump mechanism 8 and one or more keys which can operate the double-bit mechanism 34. The second type of key is preferably like that shown in FIG. 6, so that it can operate both mechanisms, thus avoiding the need for the user to keep keys of two different types. The key which can operate only the pump mechanism can, however, be entrusted to outsiders, when it is necessary to allow them access to the dwelling in the owner's absence. In this case the owner will leave the lock locked but not double-locked. In the event of prolonged absence, the owner can set the lock by means of the pump mechanism 8 and then double lock it by means of the double-bit mechanism 34, to prevent unauthorised people from entering.

Naturally, the principle of the invention remaining the same, the design details of construction may be varied widely with respect to those described and illustrated purely by way of example, without departing from the scope of the present invention.

I claim:

1. A security lock for doors comprising:

a case, a bolt movable within the case between an unlocking position and a locking position, a first locking mechanism for operating the bolt, a second locking mechanism disposed inside the case for retaining the first locking mechanism in its locked condition, and a key which can operate both the first locking mechanism and the second locking mechanism, wherein the first locking mechanism includes a rotary disc for operating the bolt, the disc is D-shaped having a flat edge which pushes against a first sliding plate which is urged against the disc by a spring, the second locking mechanism being adapted to move a second sliding plate into an operative position in which an appendage of the second sliding plate engages an edge of the first sliding plate which cooperates with the disc thus preventing the plate from moving away from the disc, so that the first locking mechanism is retained in its locked condition.

2. A lock according to claim 1, wherein the second sliding plate has an oblique slot engaged by a pin attached to a third sliding plate in contact with the second locking mechanism so that the movement of the third sliding plate brought about by the second locking mechanism forces the pin along the oblique slot which moves the second sliding plate between an operative position and an inoperative position.

3. A lock according to claim 2, including a fourth sliding plate having an L-shaped slot engaged by the pin attached to the third sliding plate, wherein the fourth sliding plate is part of a system of bolts operable by means of the first locking mechanism so that the L-shaped slot enables the third sliding plate to move only when the first locking mechanism is in the locked condition.

4. A security lock for doors comprising:

a case, a bolt movable within the case between an unlocking position and a locking position, a first locking mechanism for operating the bolt, a second locking mechanism disposed inside the case for retaining the first locking mechanism in its locked condition, and a key which can operate both the first locking mechanism and the second locking mechanism, wherein the key which can operate both locking mechanisms has an operative portion with a toothed front edge for operating the first locking mechanism and toothed side edges for operating the second locking mechanism.

5. A security lock comprising:

a case, a bolt movable within the case between an unlocking position and a locking position, a first locking mechanism which operates the bolt, the first locking mechanism having a locked position, a second locking mechanism disposed inside the case which retains the first locking mechanism in the locked position, and a key which operates both the first locking mechanism and the second locking mechanism, wherein the first locking mechanism includes a rotatable D-shaped disc having a flat edge and a first sliding plate which engages the flat edge of the disc, the second locking mechanism preventing the first sliding plate from moving away from the disc, so that the first locking mechanism is retained in the locked position.

6. A lock according to claim 5, wherein the key has a shaft, an operative portion, and a handgrip, wherein the operative portion of the key has a tray-shaped cover of plastics material with a base, two shorter lips and two longer raised lips, which can be fitted around the operative portion, each of the shorter raised lips having a central recess for engaging the shaft of the key.

7. A lock according to claim 6, wherein the cover is joined to the handgrip of the key by means of a bendable member.

8. A lock according to claim 5, further including a second sliding plate engaged by the second locking mechanism and having an operative position in which the second sliding plate engages the first sliding plate to prevent the first sliding plate from moving away from the disc.

9. A lock according to claim 8, wherein the second locking mechanism includes a third sliding plate having a pin, the second sliding plate having an oblique slot engaged by the pin so that the movement of the third sliding plate brought about by the second locking mechanism forces the pin along the oblique slot which moves the second sliding plate into the operative position.

10. A lock according to claim 9, further including a fourth sliding plate engaged by the first locking mechanism and having an L-shaped slot engaged by the pin attached to the third sliding plate, wherein the L-shaped slot permits the third sliding plate to move only when the first locking mechanism is in the locked position.

* * * * *